US007080636B2

(12) United States Patent
Knaus et al.

(10) Patent No.: US 7,080,636 B2
(45) Date of Patent: Jul. 25, 2006

(54) OIL SEPARATING DEVICE FOR A COMBUSTION ENGINE

(75) Inventors: Artur Knaus, Hamburg (DE); Wilhelm Seelandt, Rosengarten (DE)

(73) Assignee: Dichtungstechnik G. Bruss GmbH & Co. KG, Hamburg (DE)

( * ) Notice: Subject to any disclaimer, the term of this patent is extended or adjusted under 35 U.S.C. 154(b) by 0 days.

(21) Appl. No.: 10/834,231

(22) Filed: Apr. 29, 2004

(65) Prior Publication Data

US 2004/0261776 A1 Dec. 30, 2004

(30) Foreign Application Priority Data

May 5, 2003 (DE) ..... 103 20 215
Mar. 26, 2004 (DE) ..... 20 2004 004 803 U

(51) Int. Cl.
*F01M 13/04* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 3,455,285 A * 7/1969 Sheppard ..... 123/574
4,169,432 A * 10/1979 White ..... 123/41.86
4,549,520 A * 10/1985 Tamba et al. ..... 123/572
4,569,323 A * 2/1986 Okumura ..... 123/572
4,662,322 A * 5/1987 Tamba et al. ..... 123/41.86
5,024,203 A 6/1991 Hill
5,328,338 A * 7/1994 Hirano et al. ..... 417/312
5,474,035 A * 12/1995 Ming et al. ..... 123/41.86
5,579,744 A 12/1996 Trefz
5,957,118 A * 9/1999 Tateno et al. ..... 123/573
6,345,613 B1 * 2/2002 Hoffmann et al. ..... 123/572
6,364,145 B1 * 4/2002 Shaw et al. ..... 220/203.11
6,394,079 B1 * 5/2002 Takada et al. ..... 123/572
6,662,791 B1 * 12/2003 Nakamizo et al. ..... 123/572

FOREIGN PATENT DOCUMENTS

| | | |
|---|---|---|
| DE | 3128470 | 5/1983 |
| DE | 19632931 | 2/1998 |
| DE | 19951028 | 4/2001 |
| DE | 10051307 | 5/2002 |
| GB | 613386 | 11/1948 |
| GB | 1255642 | 12/1971 |

OTHER PUBLICATIONS

German Patent Search Report for DE 20 2004 004 803.5.

* cited by examiner

*Primary Examiner*—Marguerite McMahon
(74) *Attorney, Agent, or Firm*—Duane Morris LLP

(57) ABSTRACT

An oil separating device for an internal combustion engine connected in a flow path of blow-by gas, loaded with oil particles, from the crankcase to the inlet manifold section of the internal combustion engine and comprising an oil separator formed with at least one passage through which the flow of oil-bearing blow-by gas is guided and deflected, the oil particles being separated at a wall which causes them to flow back to the crankcase in an oil return path, is characterized in that the at least one passage is defined by a slot of small, variable slot width and large cross sectional area, the slot width being varied against spring force of an elastic member in dependence on the volume flow of the blow-by gas through the slot.

14 Claims, 3 Drawing Sheets

OIL SEPARATING DEVICE FOR A COMBUSTION ENGINE

An oil separating device for a combustion engine.

The instant invention relates to an oil separating device for a combustion engine, particularly an internal combustion engine.

An oil separating device as known from EP 0 472 130 A1 comprises a passage for so-called blow-by gases flowing from the combustion chambers of the cylinders of an internal combustion engine through the piston rings into the crankcase, to be returned through the oil separating device to the inlet manifold section of the internal combustion engine, said passage being defined by a slot in a slotted plate arranged transversely of the inlet direction of the blow-by gas and disposed at a fixed distance from a baffle around which the blow-by gas undergoes sharp deflection, whereby the oil particles are separated at the walls of the oil separator.

Efficient oil separators are desirable in crankcase ventilation of internal combustion engines in order to meet the strict legal exhaust gas regulations and the demand for less oil consumption.

Investigations made by the inventors have shown that the efficiency of oil separation varies in accordance the conditions of mounting of the engine, such as the inclination of the longitudinal axis of the engine and the type of charge control of the cylinders of the internal combustion engine.

Conflicting aims for the development of oil separators with gravity separation result from the requirement that there be little pressure loss because, with increasing volume flow, i.e. rising flow velocity, the pressure loss increases non-linearly. In view of the fact that in internal combustion engines the blow-by flow may vary considerably with the engine operation conditions and as, moreover, a conventional gravitational separator will not achieve satisfactory efficiency before a sufficiently high flow velocity is reached, separators of simple structure built so far cannot be more than a compromise between a decent degree of efficiency at small volume flows and great pressure losses at great volume flows.

It is, therefore, an object of the invention to provide a highly efficient oil separator for an internal combustion engine of simple structure and low tendency of contamination in which pressure losses are small and which works independently of mounting conditions of the engine and which also permits adaptation to different systems of charge control.

Claim 1 serves to meet these objects.

In an oil separating device according to the invention, at least one elastic member controlling a passage for blow-by-gas from the crankcase to the inlet manifold is exposed to the blow-by gases. The elastic member controls a variable flow cross sectional area of the passage for the blow-by-gas, thus creating almost constant flow velocities that are sufficient to provide the gravitational effects for separating the oil particles from the gas flow. This has an essential advantage in that the pressure loss rises approximately linearly with the volume flow increase across the operating range. The slot width of the or each passage varying with the volume flow or the pressure differential of the pressures prevailing in the gas flow upstream and downstream of the passage makes it possible to adapt the separating performance of the oil separator to all installation conditions and charge control methods of the internal combustion engine occurring in practice.

According to an advantageous modification of the invention the spring force of the elastic member which counteracts the pressure of the blow-by gas is provided by at least one spring member which limits the slot width of the or each passage.

In an advantageous structural embodiment of the invention the plurality of spring members are presented by the windings of a helical spring, the passages being defined between the windings. The spacing between individual windings defining the slot width varies with the volume flow through the passages or with the pressure differential between the pressures in the blow-by gas flow upstream and downstream of the passages.

A baffle may serve to separate the oil particles from the gas flow, and this baffle may be embodied by the inside wall of an oil separator casing. But it may also suffice to utilize the downstream wall portions of the windings of the helical spring themselves for separating and discharging the oil particles.

In another advantageous embodiment, of which the total height is much less, the or each elastic spring member may be embodied by a leaf or tongue spring exposed transversely of its longitudinal extension to the flow of the blow-by gas, thus uncovering a slot of a size in correspondence with the magnitude of the volume flow of the blow-by gas to let the gas pass through.

The best possible separating effect to get the oil separated from the blow-by gas is obtained according to an advantageous modification of this second embodiment of the invention with which a plurality of tongue springs clamped in cantilever fashion may be arranged transversely of the flow direction, especially in a common plane, to be exposed simultaneously to the blow-by gas flow.

A high degree of separation may be enhanced still further by forming the or each tongue spring with a baffle edge upon which the gas flowing through the slot impinges at high velocity, leaving behind oil that has been separated.

Especially preferred is an oil separating device comprising an oil separator which is integrated in the valve hood of the internal combustion engine, such as known from DE 198 13 702 C1. The integration of the oil separator in the valve hood according to the invention has the advantage that the blow-by gases can be directed through the existing oil return flow bores in the engine block towards the existing valve hood, whereby conduits for blow-by gases outside of the engine can be dispensed with.

Further modifications of the invention are protected by the other subclaims.

The invention will be described further, by way of example, with reference to the accompanying drawings, in which.

Figure 2:
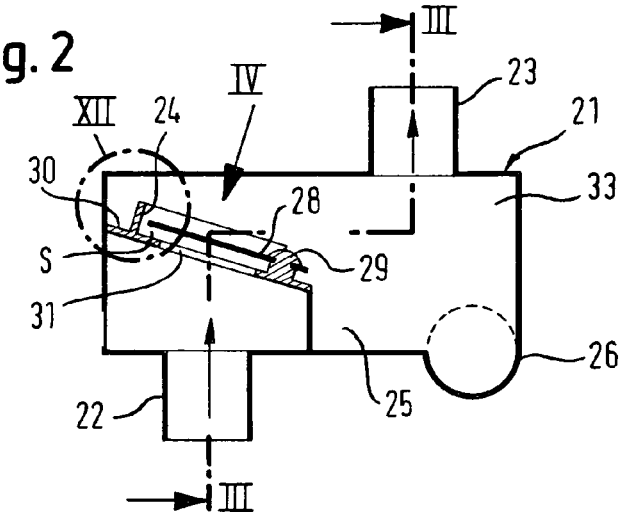
FIG. 2 is a sectional view similar to FIG. 1, showing a second embodiment of the invention, comprising resilient tongues.
Figure 7:
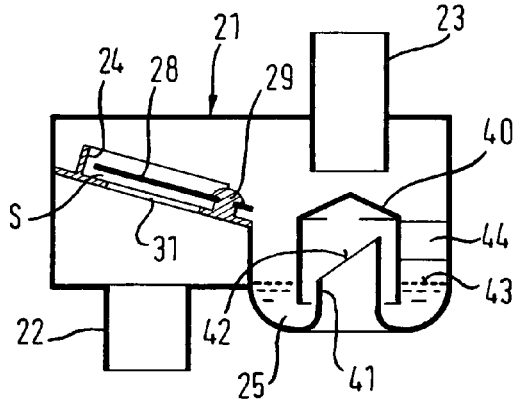
Figure 9:
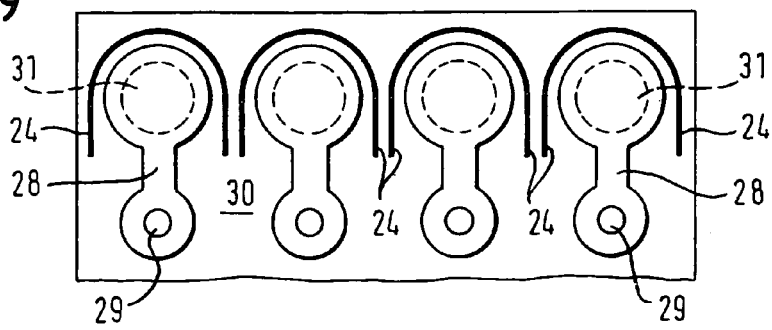
Figure 10:
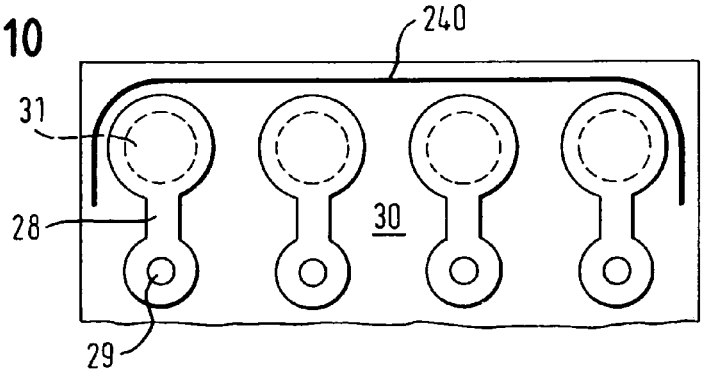
Figure 11:
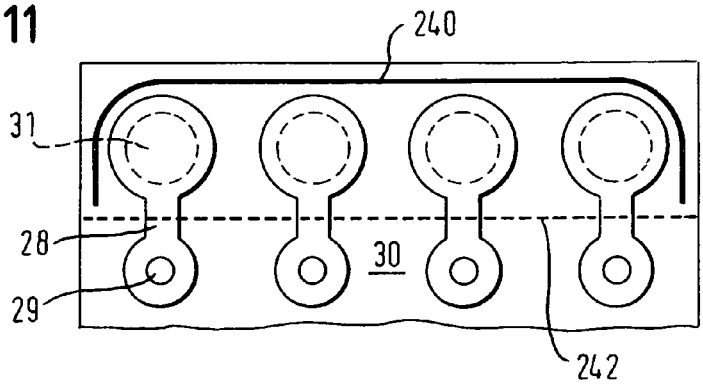
Figure 12:
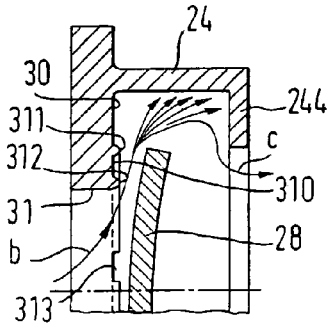
Figure 13:
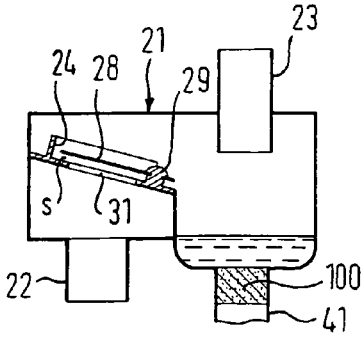
Figure 14:
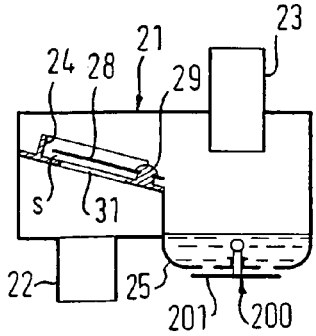

FIGS. 9, 10, and 11 are partial views in the direction of arrow IV in FIG. 2, showing alternative embodiments of resilient tongue arrangements;

FIG. 12 shows a detail at XII in FIG. 2;

FIGS. 13 and 14 show two different modifications, respectively, of the embodiment according to FIG. 7.

Figure 1:
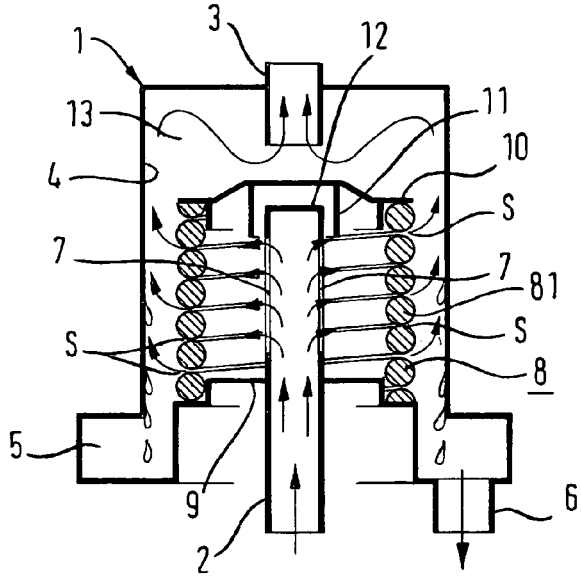
FIG. 1 shows a first embodiment of an oil separator according to the invention, comprising a helical tension spring.

In the embodiment of an oil separating device according to the invention shown in FIG. 1 a cylindrical casing 1 of the oil separator, including a feed pipe for oil-bearing blow-by gas 2, a discharge pipe 3 for oil-free blow-by gas, a baffle 4 for separated oil, a collecting space 5 for separated oil, and an oil drain pipe 6 for separated oil, is arranged vertically within the engine compartment of a motor vehicle.

The feed pipe 2 which extends from below into the vertical casing is closed at its inner upper end 12 and in its jacket, slightly below that upper end, longitudinal slots 7 are formed through which the blow-by gas enters a chamber 13 in the interior of the casing via a space within a helical tension spring 8. The helical tension spring 8 is slightly biased between a lower spring plate 9 which is firmly connected to the feed pipe 2 and an upper, movable spring plate 10 which is guided axially at the closed upper end 12 of the feed pipe 2 by a guide sleeve 11 formed in one piece with the movable spring plate 10. The vertical cylindrical inside wall of the casing 1 presents the baffle 4. In its upper range, said wall limits the chamber 13 which serves to collect the oil-free gas and through the ceiling of which passes the discharge pipe 3 for this gas.

Passages or slots s are defined between the windings of the helical tension spring 8, the slot width thereof depending on the volume flow through the slot or on the pressure differential between the pressure of the blow-by gas within the feed pipe 2 or the helical tension spring 8 and the pressure within the chamber 13 outside of the helical tension spring 8. The blow-by gas flows at great velocity through the slots s between the windings 81 towards the cylindrical baffle 4. The heavy oil particles entrained by the gas impinge on the baffle 4 and drip down from it into the collecting space 5. From the collecting space 5 they flow back into the crank-case through the oil drain pipe 6. On the other hand, the gas which has been freed of oil is deflected upwardly towards the discharge pipe 3 in the direction of the arrows shown. Alternatively and/or additionally, the windings 81 of the helical tension spring 8 themselves, with their downstream wall portions at the outside of the spring, may provide the required surfaces for separation and deviation of the oil to be separated. In that event a baffle 4 may become superfluous.

The embodiment of an oil separating device according to the invention as shown in FIGS. 2 to 7 likewise comprises a casing 21, including a feed pipe 22 for oil-bearing blow-by gas and a chamber 33 with a discharge pipe 23 for the oil-free blow-by gas. In this embodiment the interior of the casing is divided by an oblique partition 30 formed with several large passage openings 31, each of which is covered on top by a leaf spring or resilient tongue 28 fastened at their respective lower ends 29 (FIGS. 2, 6, or 7) to the partition 30. Their upper ends which jut out freely define a slot s with the partition 30. When unloaded and in a position at rest, the resilient tongue 28 fully covers the associated opening 31 in the partition 30, as may be taken particularly from FIGS. 4 and 5 which also clearly depict the circular shape of the resilient tongue 28. Each resilient tongue 28 is surrounded by a baffle 24 protruding vertically from the partition 30 and extending over the major part of the circumference of the resilient tongue 28.

Figure 3:
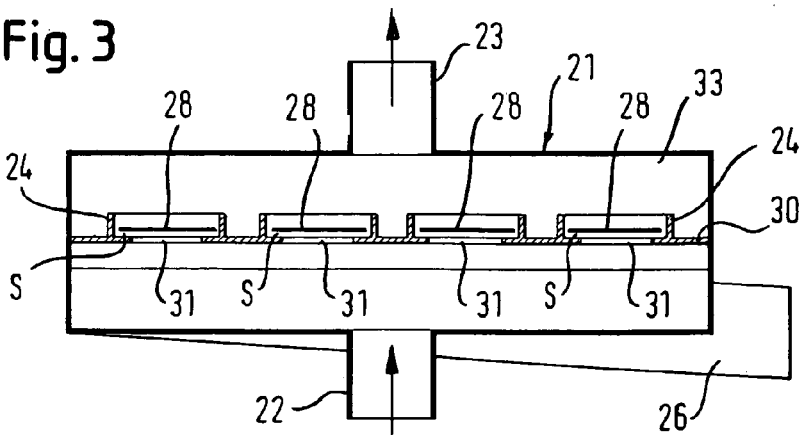
FIG. 3 is a sectional elevation along line III—III in FIG. 2.
Figure 4:
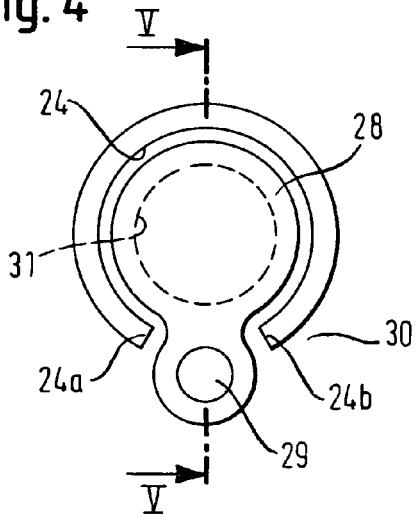
FIG. 4 is a view in the direction of arrow IV in FIG. 2, showing a tongue-type valve according to FIG. 2 or 3.
Figure 5:
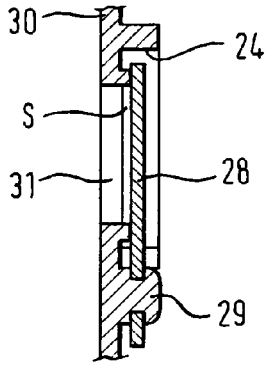
FIG. 5 is a sectional elevation along line V—V in FIG. 4.

Oil-bearing blow-by gas which flows through the feed pipe 22 into the casing 21 urges the resilient tongues 28 away from the corresponding openings 31 into an open position so that the gas first will pass through the openings 31 in the partition 30, then through the slots s between the resilient tongues 28 and the partition 30, ultimately hitting the baffles 24 at high speed and, thereby, separating the oil entrained in the gas flow. This oil will flow from the open lower ends 24*a*, 24*b* (FIG. 4) of the baffles 24 along the partition 30 down into the collecting space 25. From the collecting space 25 it will get back into the crankcase through the downwardly inclined oil drain pipe 26 (FIG. 3). The oil-free gas from the chamber 33 above the partition 30 reaches the outside through the discharge pipe 23.

Figure 6:
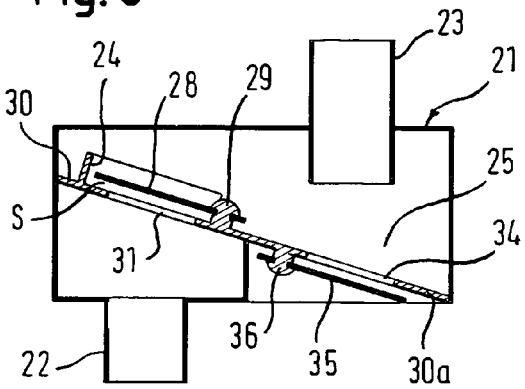
FIGS. 6 and 7 are sectional views similar to FIG. 2, showing two variants of the embodiment according to FIG. 2.

The embodiment illustrated in FIG. 6 differs from the one shown in FIGS. 2 to 5 only in that the partition 30 is extended in downward direction beyond the collecting space 25 and is formed in a lower portion 30*a* with another opening 34 overlapped by the resilient tongue 35 of a tongue-type valve which is fastened at 36, in a manner similar to the resilient tongue 28, but to the bottom side of the partition 30. The resilient tongue 35 opens, i.e. deflects downwardly, as soon as the oil pressure in the collecting space 25 exceeds a given value, thereby establishing communication with the return path (not shown) to the crankcase.

In the other modification shown in FIG. 7 of the oil separating device according to FIGS. 2 to 5, the draining of the oil is altered as follows: A gas barrier designed to prevent the return of oil-free blow-by gas into the oil return path is implemented by a riser 40 which is closed at its upper end and placed over an oil drain pipe 41 which extends into the riser 40 and has an open end 42 cut at an angle. In this way a semi-toroidal collecting space 25 is formed around the aggregate consisting of the riser 40 and the oil drain pipe 41 extending into the riser so that there always will be a gas-impervious oil level in the semi-torus to prevent any discharge of blow-by gas through the oil drain pipe 41. The riser 40 is firmly connected to the outside wall of the casing 21 by a bracket 44.

Figure 8:
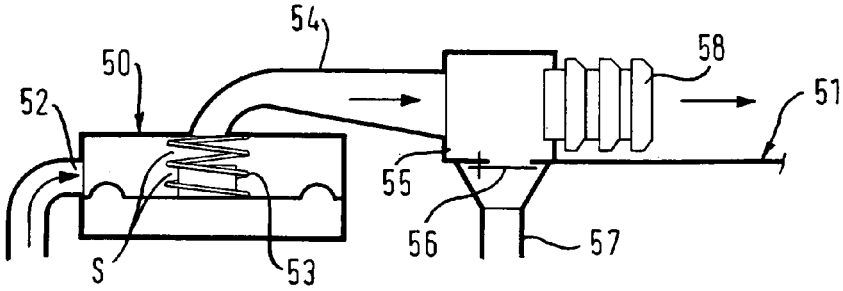
FIG. 8 shows a variant of the oil separator illustrated in FIG. 1, having a structure which is integrated in a valve hood.

The embodiment according to FIG. 8 shows a pressure regulating valve, generally designated 50, which acts as an oil separator and is integrated into a valve hood 51. Oil-bearing blow-by gas enters the casing of the pressure regulating valve 50 at entering location 52 and flows through passages or slots s between the windings of a helical spring 53, oil being separated at the bottom wall of an outlet pipe 54 due to the sharp deflection of the blow-by gas and being drained in downward direction due to the inclination of the wall. The oil reaches a drop catcher 55 provided with a tongue-type valve 56 just above an oil drain pipe 57, while the oil-free blow-by gas is returned through a hose connection piece 58 to the suction manifold section of the internal combustion engine.

FIG. 9 is a diagrammatic partial view, as seen in the direction of arrow IV in FIG. 2, of the embodiment shown in FIGS. 2 and 3. Each passage opening 31 is surrounded by its own baffle.

In the embodiment according to FIG. 10 all the passage openings 31 are surrounded by a common baffle 240. This requires less space, while the separation performance remains practically unchanged.

In the embodiment shown in FIG. 11 a cover 242 is used to cover the common baffle 240 for further improvement of the separation performance. This arrangement is open towards the bottom to permit draining of the oil which as been separated.

FIG. 12 illustrates a particularly advantageous modification of the edge strip 310 of the passage opening 31 according to FIG. 2. The corresponding resilient tongue 28 is shown in FIG. 12 in its open position, when subjected to blow-by gas, cf. arrow b. The edge strip 310 is formed by two concentric, circular protrusions 311, 312 on which the resilient tongue 28, when unloaded and inoperative, rests in sealing engagement in line contact. In this manner the separating performance can be greatly enhanced.

In another modification the baffle 24 of the embodiment illustrated in FIG. 12 is extended by a bent portion 244 bent by an angle of 90° and parallel to the partition 30. As a consequence, the gas flow is deflected once more and a better separation effect thus can be obtained, as indicated by arrow c which indicates the path of the oil-free gas. Arrows a indicate the flow paths of the oil particles of which the smaller and smallest particles become deposited on the inner wall of the bent portion 244.

Finally, FIG. 12 also indicates a slit 313 which extends radially through the protrusions 311, 312. This slit serves to prevent a tendency observed after longer periods of rest of the resilient tongues 28, namely of a tongue to stick to the border strip 310.

Instead of providing a slit 313, the border strip may be roughened.

In FIG. 13 a modification of the embodiment of FIG. 7 is shown. While in FIG. 7 a siphon having a riser 40, a collecting space 25 and an oil drain pipe 41 serves as a gas barrier, the embodiment of FIG. 13 makes use of a sintered body 100 made of sintered material, particularly of an unfilled plastic, e.g. an oil resistant, high-temperature resistant type, like polyamide or polyphenylensulfide, is inserted into the oil drain pipe 41. In an oil impregnated state such a sintered body allows only oil, but no blow-by-gases to pass therethrough.

The structure of the sintered body may easily be manufactured as requiring merely insertion of the sintered body 100, which is a component to be made at low cost, into the oil drain pipe 41.

According to FIG. 14, a pot-shaped collecting space 25 is provided as a further modification of the siphon according to FIG. 7, in the bottom of which a gas barrier in form of a membrane valve 200 comprising a rubber membrane 201 is clicked-in which opens at a negative pressure and thereby allows oil collected in the collecting space 25 to drain.

The features disclosed in the specification above, in the claims and drawing may be significant for implementing the invention in its various embodiments, both individually and in any combination.

LIST OF REFERENCE NUMERALS

1, 21 casing
2, 22 feed pipe
3, 23 discharge pipe
4, 24 baffle
5, 25 collecting space
6, 26 oil drain pipe
7 longitudinal slots
8 helical tension spring
9 lower spring plate
10 upper spring plate
11 guide sleeve
12 closed upper end
13, 33 chamber
28, 35 resilient tongue
29, 36 fastening of resilient tongue
30 partition
30*a* lower portion of partition
31 passage opening
34 opening for draining oil
40 riser
41 oil drain pipe
42 open end cut at an angle
43 oil level
50 pressure regulating valve
51 valve hood
52 entering location
53 helical spring
54 drain pipe
55 drop catcher
56 tongue-type valve
57 oil drain pipe
58 hose connection piece
100 sintered body
200 membrane valve
240 baffle
242 cover
244 bent portion
310 border strip
311, 312 protrusions
313 slit

What is claimed is:

1. An oil separating device for an internal combustion engine connected in a flow path of blow-by gas, loaded with oil particles, from the crankcase to the suction manifold section of the internal combustion engine and comprising an oil separator formed with at least one constricted passage through which the flow of oil-bearing blow-by gas is guided and deflected, the oil particles being separated at a wall which causes them to flow back to the crankcase in an oil return path, wherein the at least one passage is formed by a slot having a variable slot width and large cross sectional slot area, the slot width being varied against spring force applied by at least one resilient tongue the flat side of which is exposed to the gas flow transversely of its longitudinal extension, uncovering a slot for passage of the blow-by gas flow in response to the magnitude of the volume flow which depends on the operating point of the internal combustion engine, wherein at least one baffle associated with the at least one resilient tongue member is provided downstream of the passage in the direction of flow to separate the oil particles, wherein the baffle forms a border strip located at a periphery of the at least one passage and having at least one protrusion against which the at least one resilient tongue, when in the state of not being subjected to the gas flow, abuts in sealing contact wherein the at least one baffle comprises a bent portion.

2. The device as claimed in claim 1, wherein each resilient tongue is characterized by damping which attenuates vibrations of the resilient tongue and which includes a coating of damping material having an elastomer coat.

3. The device as claimed in claim 1, wherein a plurality of resilient tongues clamped in cantilever fashion are provided transversely of the direction of flow for simultaneous exposure to the blow-by gas flow.

4. The device as claimed in claim 1, wherein the border strip comprises a slit portion extending through the at least one protrusions.

5. The device as claimed in claim 1, wherein the border strip comprises a roughened portion.

6. The device as claimed in claim 1, being integrated in a valve hood of the internal combustion engine.

7. The device of claim 1 wherein the border strip has two protrusions.

8. An oil separating device for an internal combustion engine connected in a flow path of blow-by gas, loaded with oil particles, from the crankcase to the suction manifold section of the internal combustion engine and comprising an oil separator formed with at least one constricted passage through which the flow of oil-bearing blow-by gas is guided and deflected, the oil particles being separated at a wall which causes them to flow back to the crankcase in an oil return path, wherein the at least one passage is formed by a slot having a variable slot width and large cross sectional slot area, the slot width being varied against spring force applied by at least one resilient tongue the flat side of which is exposed to the gas flow transversely of its longitudinal extension, uncovering a slot for passage of the blow-by gas flow in response to the magnitude of the volume flow which depends on the operating point of the internal combustion engine, wherein at least one baffle associated with the at least one resilient tongue member is provided downstream of the passage in the direction of flow to separate the oil particles, wherein the baffle is extended by a bent portion to provide a further deflection of the gas flow.

9. The device of claim 8 where the bent portion is bent at an angle of 90 degrees from the wall.

10. The device of claim 8 wherein each resilient tongue is characterized by damping which attenuates vibrations of the resilient tongue and which includes a coating of damping material having an elastomer coat.

11. The device of claim 8 wherein the baffle forms a border strip located at a periphery of the at least one passage and having a least one protrusion against which the at least one resilient tongue, when in the state of not being subjected to the gas flow, abuts in sealing contact.

12. The device of claim 11 wherein the border strip comprises a slit portion extending through the protrusions.

13. The device of claim 11 wherein the border strip comprises a roughened portion.

14. The device of claim 8 being integrated in a valve hood of the internal combustion engine.

* * * * *